US011730657B2

(12) United States Patent
Wang

(10) Patent No.: US 11,730,657 B2
(45) Date of Patent: Aug. 22, 2023

(54) TENSION ADJUSTMENT STRUCTURE OF HAND REHABILITATION DEVICE

(71) Applicant: YONG TAI GLOBAL CO., LTD., Tainan (TW)

(72) Inventor: Tseng-Chiu Wang, Tainan (TW)

(73) Assignee: Yong Tai Global Co., Ltd., Tainan (TW)

( * ) Notice: Subject to any disclaimer, the term of this patent is extended or adjusted under 35 U.S.C. 154(b) by 362 days.

(21) Appl. No.: 16/939,335

(22) Filed: Jul. 27, 2020

(65) Prior Publication Data

US 2021/0045956 A1 Feb. 18, 2021

(30) Foreign Application Priority Data

Aug. 15, 2019 (TW) ..... 108210820

(51) Int. Cl.
*A61H 1/02* (2006.01)

(52) U.S. Cl.
CPC ..... *A61H 1/0288* (2013.01); *A61H 1/0285* (2013.01); *A61H 2201/0192* (2013.01); *A61H 2201/165* (2013.01); *A61H 2201/1638* (2013.01)

(58) Field of Classification Search
CPC .. A61H 1/0285–0288; A61H 2201/165; A61H 2201/0192; A61H 2001/027
See application file for complete search history.

(56) References Cited

U.S. PATENT DOCUMENTS 3,756,222 A * 9/1973 Ketchum ..... A61H 1/0288 601/40
5,683,351 A * 11/1997 Kaiser ..... A61H 1/0288 601/40
8,715,252 B2 * 5/2014 Connor ..... A61M 35/003 604/289

FOREIGN PATENT DOCUMENTS

CN 110141461 A * 8/2019 ..... A61H 1/0288
CN 111631901 A * 9/2020 ..... A61H 1/0214
TW M516411 U 2/2016
TW I541011 B * 7/2016 ..... A61H 1/02
TW I541011 B 7/2016

OTHER PUBLICATIONS

Page and line numbering for TWI541011B, copied from Google Patents to Microsoft Word to PDF on Nov. 9, 2022. (Year: 2022).*

(Continued)

*Primary Examiner* — Valerie L Woodward
*Assistant Examiner* — Allison S. Lown
(74) *Attorney, Agent, or Firm* — Rosenberg, Klein & Lee

(57) ABSTRACT

A tension adjustment structure of a hand rehabilitation device includes a palm orthosis body, a forearm orthosis body, and a tension adjustment unit. The palm orthosis body includes a plurality of finger support rods and a thumb support rod. The forearm orthosis body includes a fixing seat. The tension adjustment unit includes a plurality of elastic members. First ends of the elastic members are connected to the finger support rods and the thumb support rod, respectively. Second ends of the elastic members are connected to the fixing seat. The elastic members are adjustable to generate different stretching tensions by adjusting respective lengths of the second ends of the elastic members to be secured to the fixing seat.

8 Claims, 8 Drawing Sheets

(56) References Cited

OTHER PUBLICATIONS

Page and line numbering for CN110141461A, copied from PE2E Search (translation by Clarivate Analytics) to Microsoft Word to PDF on Nov. 17, 2022. (Year: 2022).*
Page and line numbering for CN111631901, copied from Espacenet to Microsoft Word to PDF on Nov. 16, 2022. (Year: 2022).*
Merriam-Webster, Synonyms of "Rope", An Encyclopedia Britannica Company, saved to PDF on Dec. 2, 2022. (Year: 2022).*
Merriam-Webster, Synonyms of "Secure", An Encyclopedia Britannica Company, saved to PDF on Dec. 2, 2022. (Year: 2022).*

* cited by examiner

TENSION ADJUSTMENT STRUCTURE OF HAND REHABILITATION DEVICE

FIELD OF THE INVENTION

The present invention relates to a hand rehabilitation device that can be adjusted according to the stretching tension required by a user's different fingers or thumb for rehabilitation.

BACKGROUND OF THE INVENTION

As is known, in the case of damages to the joint tissues subsequent to stroke, surgery or traumas, the normal functionality of the hand, fingers or wrist may be altered, with both physical and psychological consequences. In general, it is necessary to use a hand rehabilitation device for rehabilitation.

Taiwan Patent Publication No. 1541011 discloses a hand rehabilitation device, published on Jul. 11, 2016. The hand rehabilitation device includes a palm-shape plate and a forearm fixing plate. The palm-shape plate and the forearm fixing plate are connected to each other to form an included angle. The top and one side of the palm-shape plate are provided with five rods and five finger sleeves for receiving the user's fingers. One end of a pulling rope is connected to each finger sleeve, and the other end of the pulling rope is inserted through a guide groove of each rod and a guide collar and then secured to a collection collar. One end of a connecting rope is fixed to the collection collar. An upper arm fixing plate is provided with a pulling rope adjustment assembly. The other end of the connecting rope is fixed to the pulling rope adjustment assembly. The upper arm fixing plate is attached to the upper arm. The forearm fixing plate is attached to the forearm. All the pulling ropes can be pulled to be tightened or loosened by moving the upper arm or using the other hand to pull the connecting rope, thereby enabling the five fingers to stretch or bend for rehabilitation.

In the above-mentioned patent, by pulling a handle fixed to the other end of the connecting rope, all the pulling ropes are pulled to be tightened or loosened, enabling the five fingers to stretch or bend for rehabilitation. Because all the pulling ropes are pulled at a time to adjust the five fingers for rehabilitation, it is unable to adjust different elastic forces for different fingers separately according to the bending degree of different fingers, so it is not ideal for use.

In addition, Taiwan Utility Model Publication No. M516411 discloses a hand dynamic orthosis, published on Feb. 1, 2016. The hand dynamic orthosis includes an orthosis plate. The orthosis plate is provided with a finger traction elastic assembly corresponding to each finger of the human body. Each finger traction elastic assembly includes an elastic line. One end of the elastic line is defined as an elastic positioning end positioned on the surface of the orthosis plate, and the other end of the elastic line is extended with a set length and provided with a strap. After the orthosis plate is worn on the patient's hand, when the finger sleeved with the finger traction elastic assembly is to bend and stretch to pull the elastic positioning end at the other end of the finger traction elastic assembly in an elastic manner, so as to form corresponding elastic traction to bend and stretch the proximal and distal joints of the patient's finger for dynamic rehabilitation of the hand.

In the above-mentioned patent, after the orthosis plate is worn on the patient's hand, when the finger tied to one end of the elastic line of the finger traction elastic assembly is to bend and stretch, the other end of the elastic line of the finger traction elastic assembly will form the elastic traction function for rehabilitation. It can be installed in accordance with the different conditions of the proximal and distal joints of the patient's finger. Besides, in various situations during the training, through an elastic coil (spring), the relative elasticity is adjusted for better rehabilitation. Because the elasticity of the general spring is relatively large, it is not suitable for patients whose fingers cannot be controlled to perform fine adjustment. Moreover, due to the excessive force of the spring, the patient's fingers cannot move at all. It is difficult to achieve the effects of training and rehabilitation. The adjustment of the elasticity of the spring is limited. If it is required for small elasticity, a spring with few coils and a small diameter is replaced. Therefore, it is quite troublesome and time-consuming to disassemble and replace the spring.

SUMMARY OF THE INVENTION

In view of the shortcomings of the prior art, the primary object of the present invention is to provide a tension adjustment structure of a hand rehabilitation device, comprising a palm orthosis body, a forearm orthosis body, and a tension adjustment unit. The palm orthosis body includes a plurality of adjustable finger support rods and an adjustable thumb support rod. The forearm orthosis body is coupled to the palm orthosis body. The forearm orthosis body includes a fixing seat. The tension adjustment unit includes a plurality of elastic members. First ends of the elastic members are connected to the finger support rods and the thumb support rod, respectively. Second ends of the elastic members are connected to the fixing seat. The elastic members are adjustable to generate different stretching tensions by adjusting respective lengths of the second ends of the elastic members to be secured to the fixing seat.

Preferably, the palm orthosis body includes a plurality of first fixing portions and a plurality of adjustment seats connected to the respective first fixing portions with first fixing bolts. The adjustment seats can be moved and adjusted forward and backward relative to the corresponding first fixing portions for adjusting the adjustment seats to be located at different positions on the corresponding first fixing portions.

Preferably, the finger support rods are connected to the respective adjustment seats with second fixing bolts. The finger support rods can be turned and adjusted up and down relative to the corresponding adjustment seats for adjusting different angles of the finger support rods.

Preferably, the finger support rods each have at least one perforation. The first ends of the elastic members are inserted through the perforations of the finger support rods and connected to distal ends of the finger support rods, respectively.

Preferably, the palm orthosis body includes a second fixing portion. The thumb support rod is connected to the second fixing portion with a third fixing bolt. The thumb support rod can be turned and adjusted up and down relative to the second fixing portion for adjusting a different angle of the thumb support rod.

Preferably, the fixing seat has a lateral through hole. A pressing block is provided in the through hole. The pressing block is formed with a penetrating hole corresponding to the through hole. The fixing seat is provided with a longitudinal adjustment bolt. One end of the adjustment bolt is connected to the pressing block. The adjustment bolt is rotatable on the fixing seat to move the pressing block in the through hole for the penetrating hole to be aligned or staggered with the through hole so that the second ends of the elastic members can be loosened or fastened for adjusting the respective lengths of the second ends of the elastic members to be pressed by the pressing block so as to generate the different stretching tensions.

Preferably, the fixing seat has a pressing region. A plurality of pressing blocks is pivotally connected to the fixing seat. Each of the pressing blocks includes a pulling portion and an eccentric cam portion. The pulling portion is pulled to pivot the eccentric cam portion so that the eccentric cam portion is moved to the pressing region. The second ends of the elastic members are inserted through the pressing region and pressed and secured by the eccentric cam portions of the pressing blocks. The second ends of the elastic members can be adjusted for adjusting the respective lengths of the second ends of the elastic members to be pressed by the pressing blocks so as to generate the different stretching tensions.

Preferably, the palm orthosis body includes a first pivot portion. The forearm orthosis body includes a second pivot portion. The second pivot portion is pivotally connected to the first pivot portion so that the palm orthosis body can pivot an angle relative to the forearm orthosis body.

Preferably, two sides of the forearm orthosis body are provided with fastening straps. The fastening straps are secured with a hook-and-loop tape. Finger sleeves are connected to distal ends of the finger support rods and the thumb support rods, respectively.

Preferably, the elastic members are elastic ropes.

The above technical features have the following advantages:

1. The respective lengths of the second ends of the elastic members to be pressed by the pressing block are adjustable, so that the different elastic members produce different degrees of elasticity, that is, the elasticity of the respective elastic members can be adjusted according to the different stretching tensions required by the fingers or the thumb for rehabilitation.

2. According to the different lengths of the fingers, the positions of the adjustment seats and the finger support rods can be easily adjusted for rehabilitation.

3. According to the different bending angles of the fingers, the angles of the finger support rods can be turned and adjusted up and down on the adjustment seats for rehabilitation.

4. According to the thumb corresponding to the different direction of the first, the angle of the thumb support rod can be turned and adjusted up and down on the second fixing portion for rehabilitation.

DETAILED DESCRIPTION OF THE PREFERRED EMBODIMENTS

Embodiments of the present invention will now be described, by way of example only, with reference to the accompanying drawings.

Figure 1:
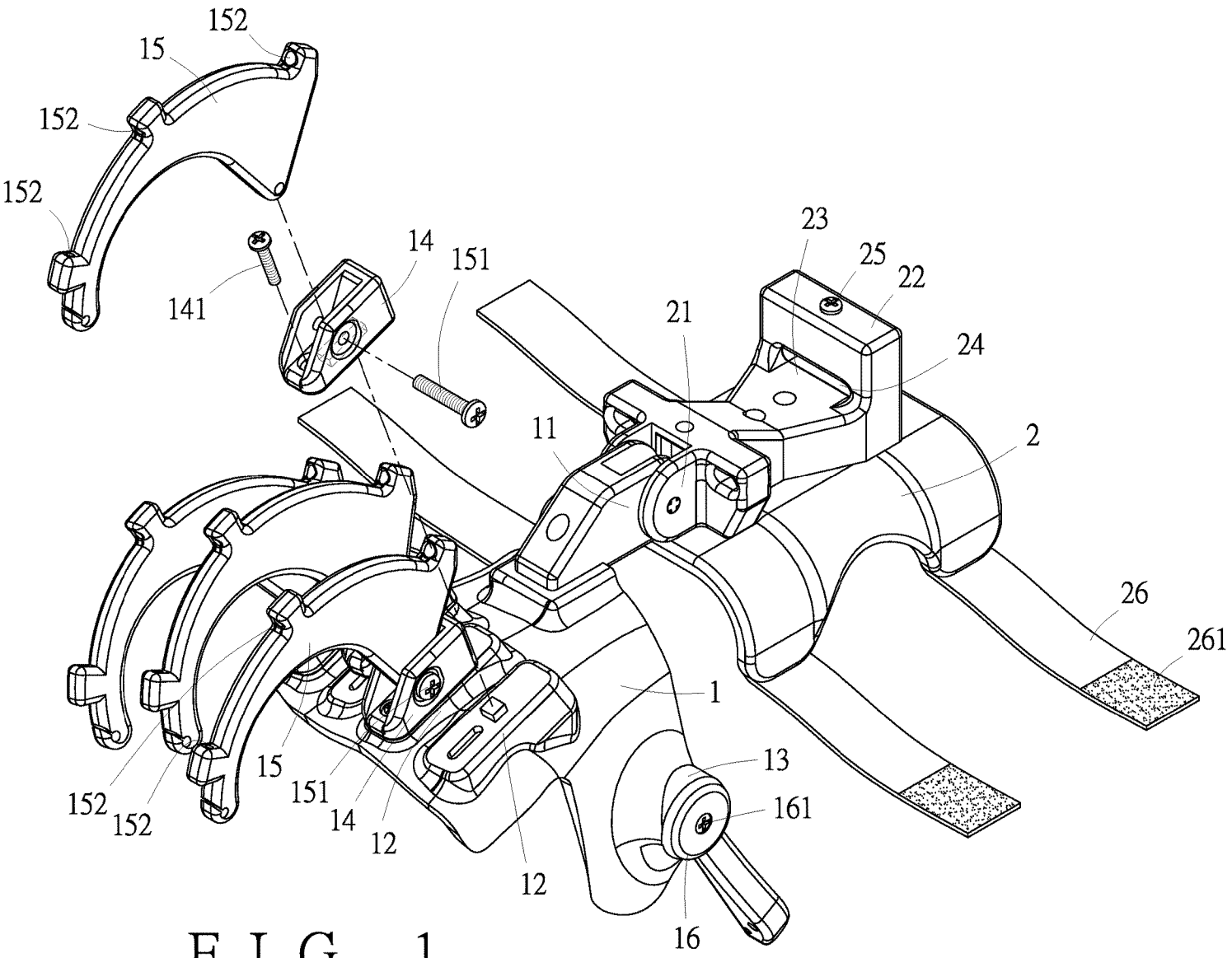
FIG. 1 is an exploded view according to a first embodiment of the present invention.
Figure 2:
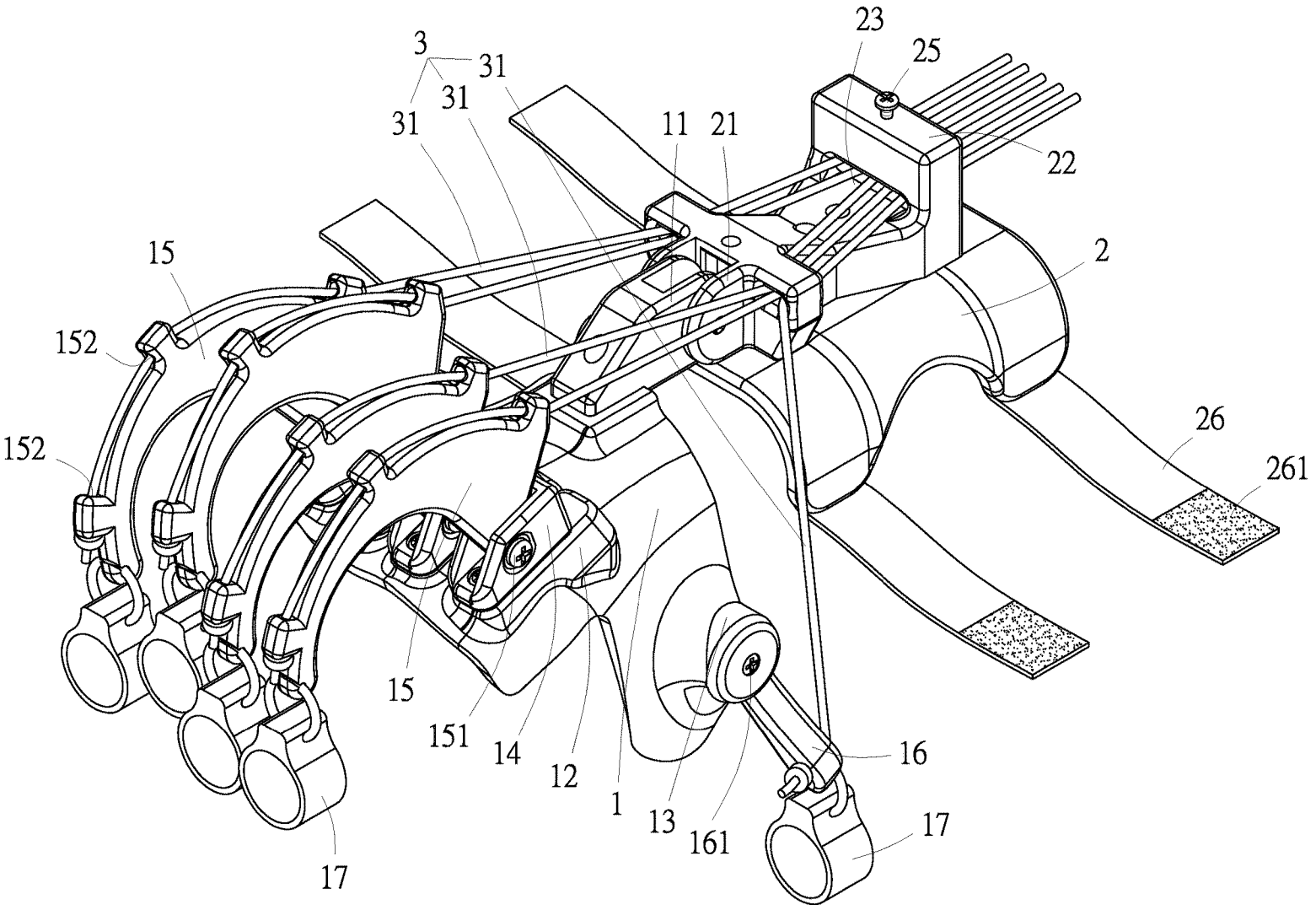
FIG. 2 is a perspective view according to the first embodiment of the present invention.

As shown in FIG. 1 and FIG. 2, a tension adjustment structure of a hand rehabilitation device according to a first embodiment of the present invention comprises a palm orthosis body (1), a forearm orthosis body (2), and a tension adjustment unit (3).

One end of the palm orthosis body (1) is provided with a first pivot portion (11). The other end of the palm orthosis body (1) is provided with a plurality of first fixing portions (12) and a second fixing portion (13). A plurality of adjustment seats (14) are connected to the first fixing portions (12), respectively. The adjustment seats (14) can be moved and adjusted forward and backward relative to the corresponding first fixing portions (12) and fastened with first fixing bolts (141), respectively. A plurality of finger support rods (15) are connected to the adjustment seats (14), respectively. The finger support rods (15) can be turned and adjusted up and down relative to the corresponding adjustment seats (14) and fastened with second fixing bolts (151), respectively. The finger support rods (15) each have at least one perforation (152). A thumb support rod (16) is connected to the second fixing portion (13). The thumb support rod (16) can be turned and adjusted up and down relative to the second fixing portion (13) and fastened with a third fixing bolt (161). Finger sleeves (17) are connected to the respective distal ends of the finger support rods (15) and the thumb support rod (16) for a user's fingers to be inserted and positioned in the finger sleeves (17).

Figure 3:
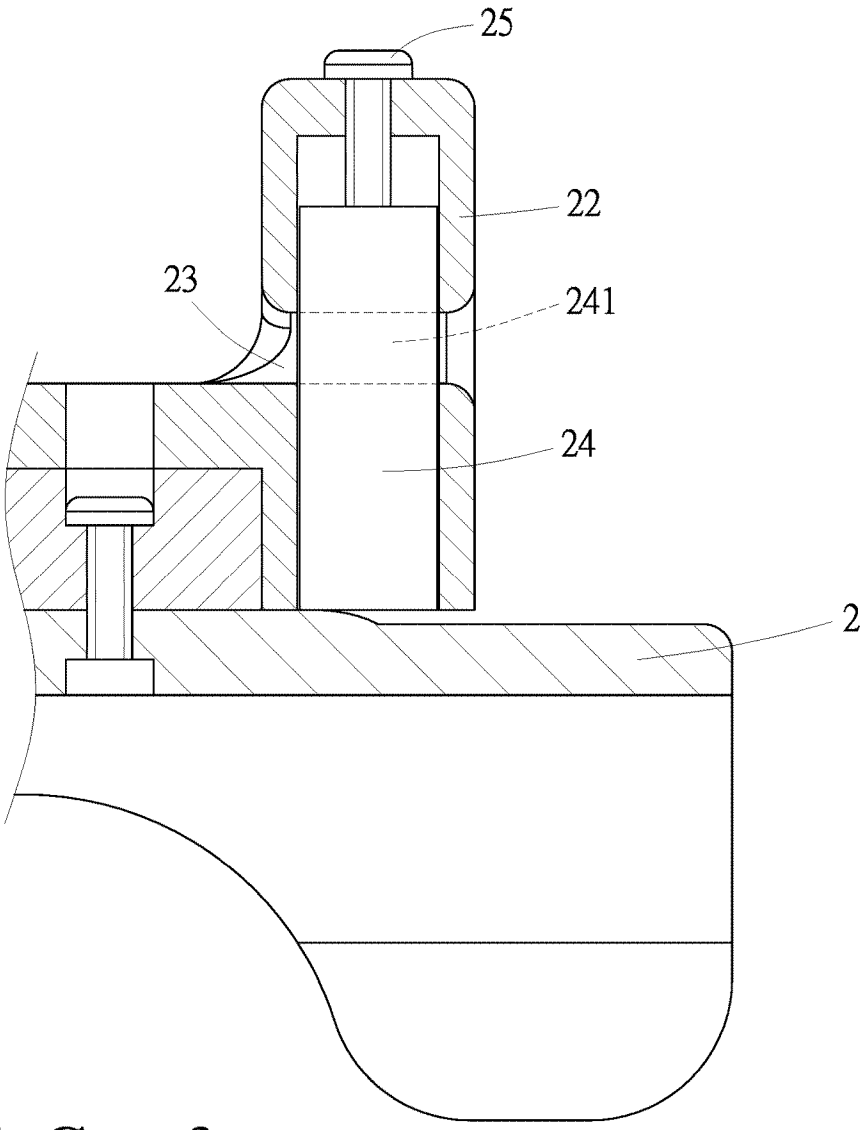
FIG. 3 is a cross-sectional view of the fixing seat according to the first embodiment of the present invention.

The forearm orthosis body (2) includes a second pivot portion (21). The second pivot portion (21) is pivotally connected to the first pivot portion (11), so that the palm orthosis body (1) can pivot an angle relative to the forearm orthosis body (2). The forearm orthosis body (2) further includes a fixing seat (22). The fixing seat (22) has a lateral through hole (23). A pressing block (24) is provided in the through hole (23), as shown in FIG. 3. The pressing block (24) is formed with a penetrating hole (241) corresponding to the through hole (23). The fixing seat (22) is provided with a longitudinal adjustment bolt (25). One end of the adjustment bolt (25) is connected to the pressing block (24). The adjustment bolt (25) is rotatable on the fixing seat (22) to move the pressing block (24) in the through hole (23) for the penetrating hole (241) to be aligned or staggered with the through hole (23). Two sides of the forearm orthosis body (2) are provided with fastening straps (26). The fastening straps (26) are secured with a hook-and-loop tape (261).

Figure 4:
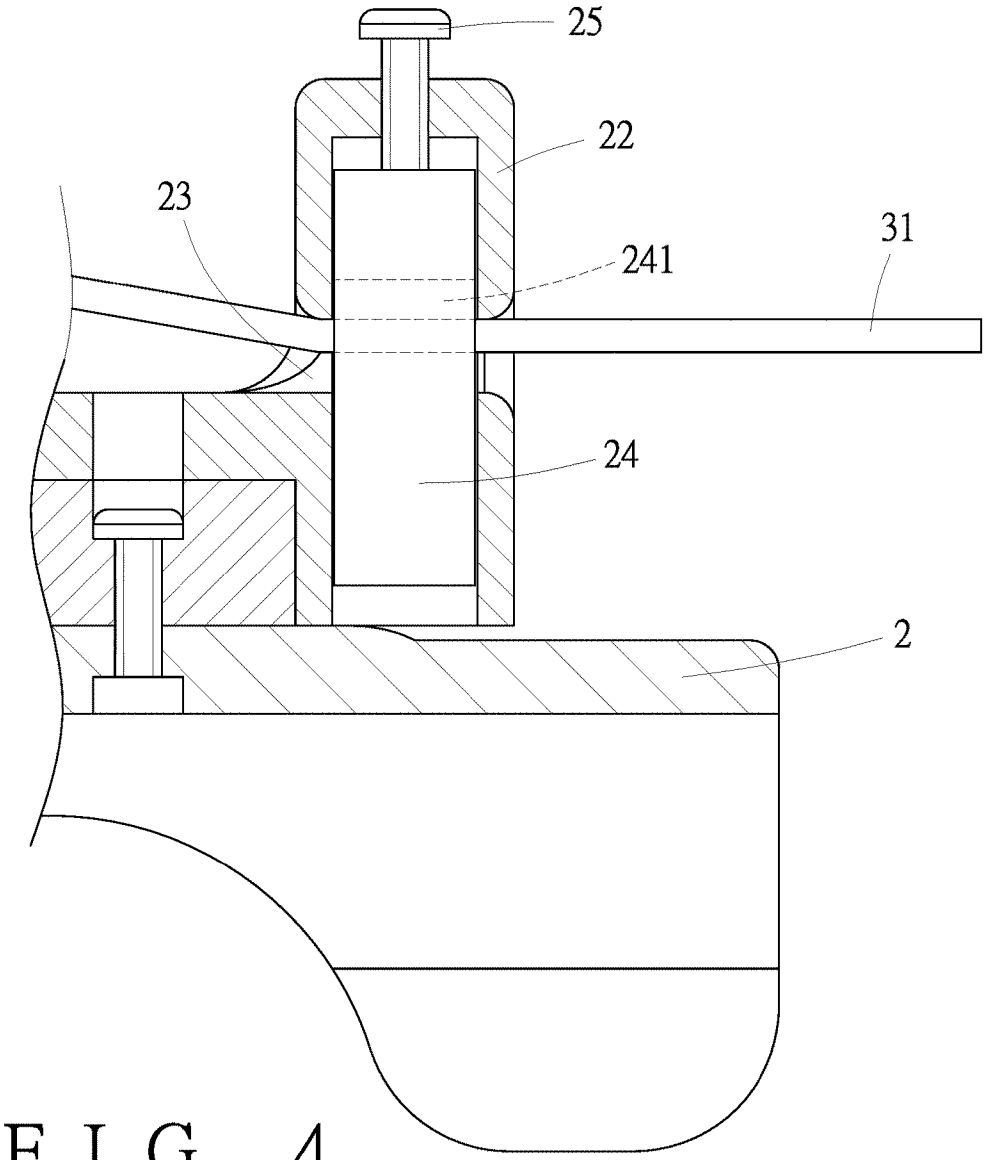
FIG. 4 is a schematic view showing that the elastic member is pressed and tightened by the pressing block according to the first embodiment of the present invention.

The tension adjustment unit (3) includes a plurality of elastic members (31). The elastic members (31) are elastic ropes. A first end of one of the elastic members (31) is directly fixed to the distal end of the thumb support rod (16). First ends of the other elastic members (31) are inserted through the perforations (152) of the finger support rods (15) and connected to the distal ends of the finger support rods (15), respectively. Second ends of the elastic members (31) are inserted through the through hole (23) and the penetrating hole (241) and then are pressed and fixed by the pressing block (24), as shown in FIG. 4.

Figure 5:
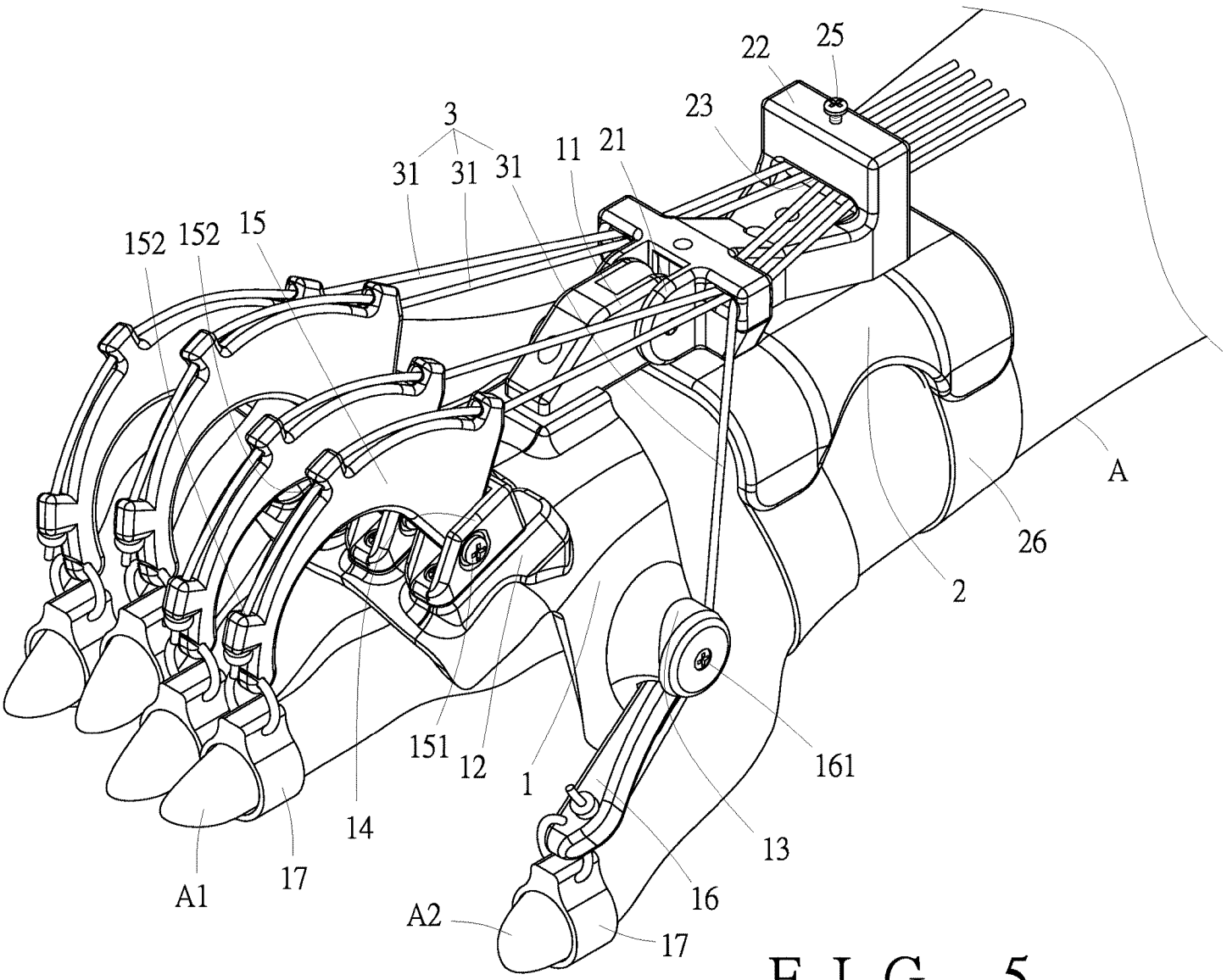
FIG. 5 is a schematic view according to the first embodiment of the present invention when in use.

When in use, as shown in FIG. 1 and FIG. 5, the forearm orthosis body (2) is fitted onto a user's forearm (A) close to the wrist, and the fastening straps (26) on both sides of the forearm orthosis body (2) are wound around the forearm (A) and secured with the hook-and-loop tape (261), so that the forearm (A) is positioned in the forearm orthosis body (2). Then, the user's fingers (A1) and thumb (A2) are inserted and positioned in the finger sleeves (17) of the finger support rods (15) and the thumb support rod (16), respectively.

As shown in FIG. 1 and FIG. 5, when it is necessary to adjust the position of the corresponding finger support rod (15) according to the different length of any one of the fingers (A1), the corresponding first fixing bolt (141) is loosened, and then the corresponding adjustment seat (14) is moved and adjusted forward and backward relative to the corresponding first fixing portion (12). After the adjustment is completed, the corresponding first fixing bolt (141) is tightened again. In this way, according to the different lengths of the fingers (A1), the positions of the adjustment seats (14) and the finger support rods (15) can be adjusted for rehabilitation.

As shown in FIG. 1 and FIG. 5, when it is necessary to adjust the bending angle of any one of the fingers (A1), the corresponding second fixing bolt (151) is loosened, and then the angle of the corresponding finger support rod (15) is turned and adjusted up and down relative to the corresponding adjustment seat (14). After the adjustment is completed, the corresponding second fixing bolt (151) is tightened again. In this way, according to the different bending angles of the fingers (A1), the angles of the finger support rods (15) can be adjusted for rehabilitation.

As shown in FIG. 1 and FIG. 5, when it is necessary to adjust the thumb (A2) corresponding to the different direction of the first (the direction of the first refers to the different angle of the thumb (A2) toward any one of the fingers (A1)), the third fixing bolt (161) is loosened, and then the angle of the thumb support rod (16) is turned and adjusted up and down relative to the second fixing portion (13). After the adjustment is completed, the third fixing bolt (161) is tightened again. In this way, according to the thumb (A2) corresponding to the different direction of the first, the angle of the thumb support rod (16) is adjusted for rehabilitation.

Figure 6:
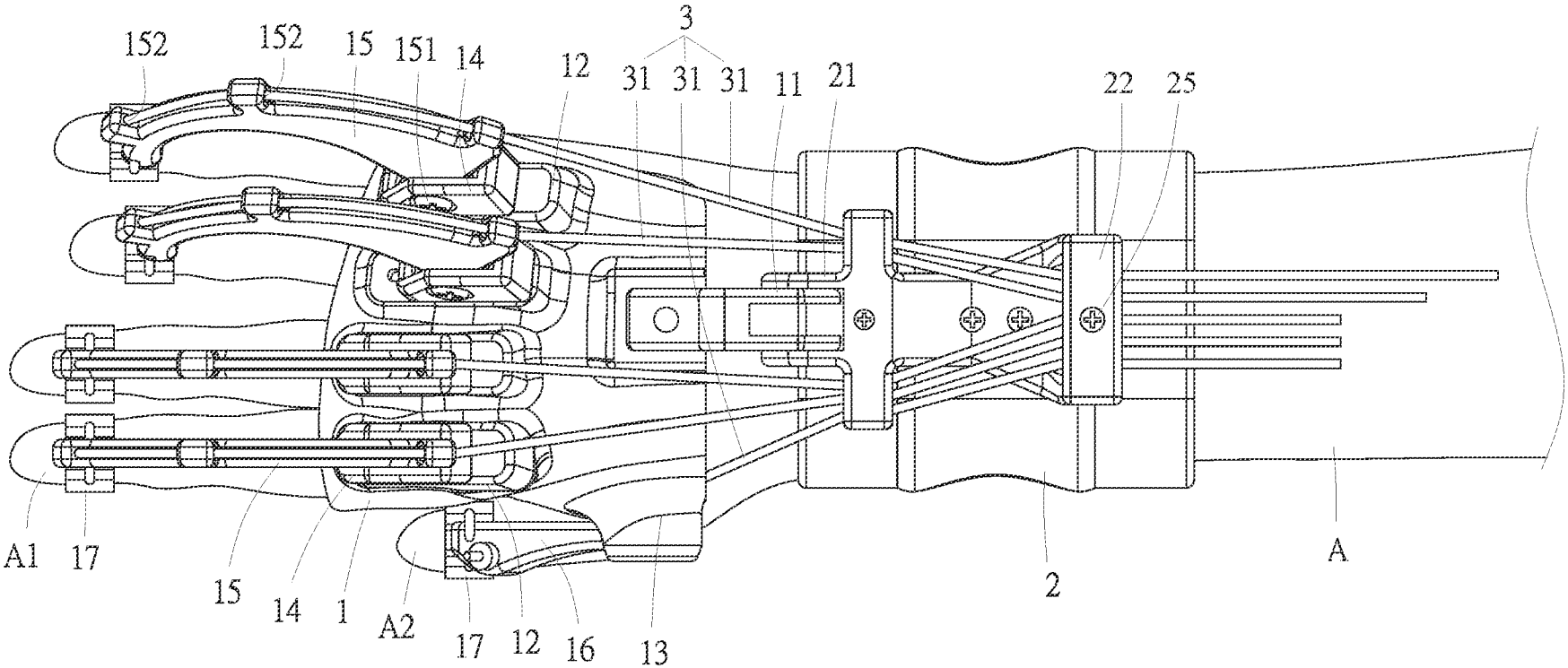
FIG. 6 is a top view according to the first embodiment of the present invention when in use.

As shown in FIG. 5 and FIG. 6, when it is necessary to adjust the stretching tension for any one of the fingers (A1) or the thumb (A2), the adjustment bolt (25) on the fixing seat (22) is slightly loosened, and the penetrating hole (241) is partially staggered with the through hole (23), and the pressing block (24) still keeps the pressure capable of pressing the second ends of the elastic members (31). Then, according to the desired stretching tension for any one of the fingers (A1) or the thumb (A2), the corresponding elastic member (31) is selectively tightened or loosened by adjusting the length of the second end of the corresponding elastic member (31) to be pressed under the pressing block (24), so that the elasticity of the elastic member (31) pressed under the pressing block (24) can be adjusted. By tightening the second end of the elastic member (31), the corresponding finger (A1) is given a greater stretching tension. By loosening the second end of the elastic member (31), the corresponding finger (A1) is given a smaller stretching tension. After the stretching tension is adjusted, the adjustment bolt (25) is tightened again, so that the penetrating hole (241) is completely staggered with the through hole (23), so as to drive the pressing block (24) to press and secure the second ends of the elastic members (31), as shown in FIG. 4. In this way, the elasticity of the respective elastic members (31) can be adjusted according to different stretching tensions required by the fingers (A1) or the thumb (A2) for rehabilitation.

Figure 7:
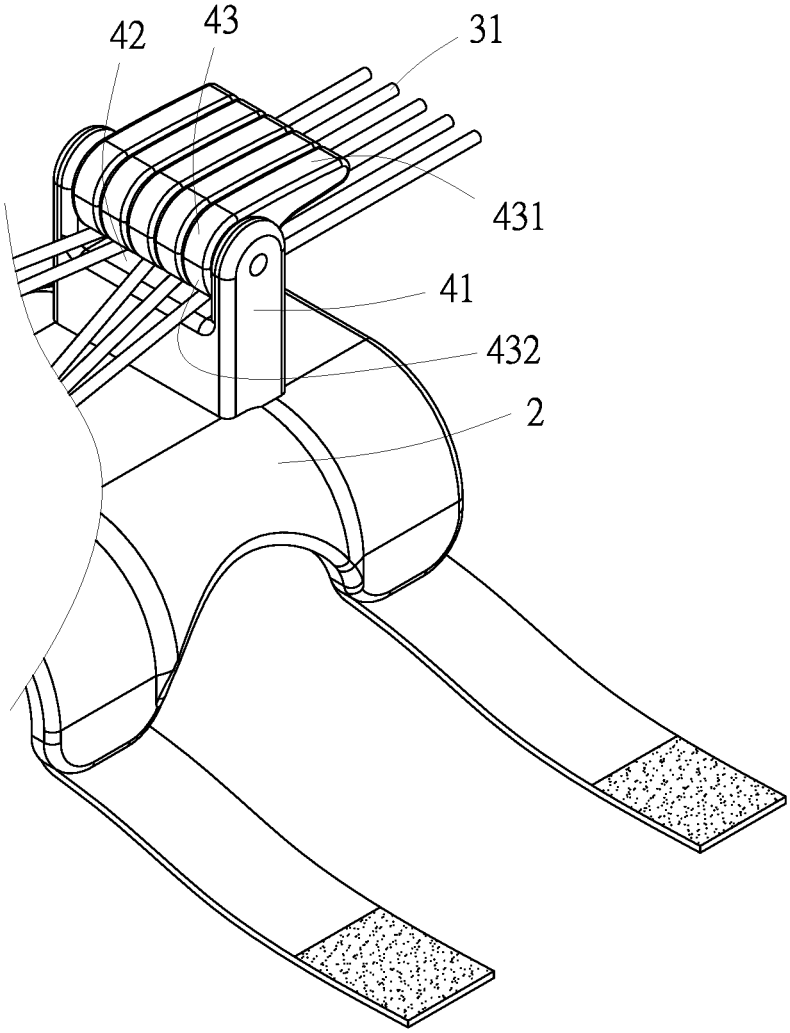
FIG. 7 is a partial enlarged view according to a second embodiment of the present invention.
Figure 8:
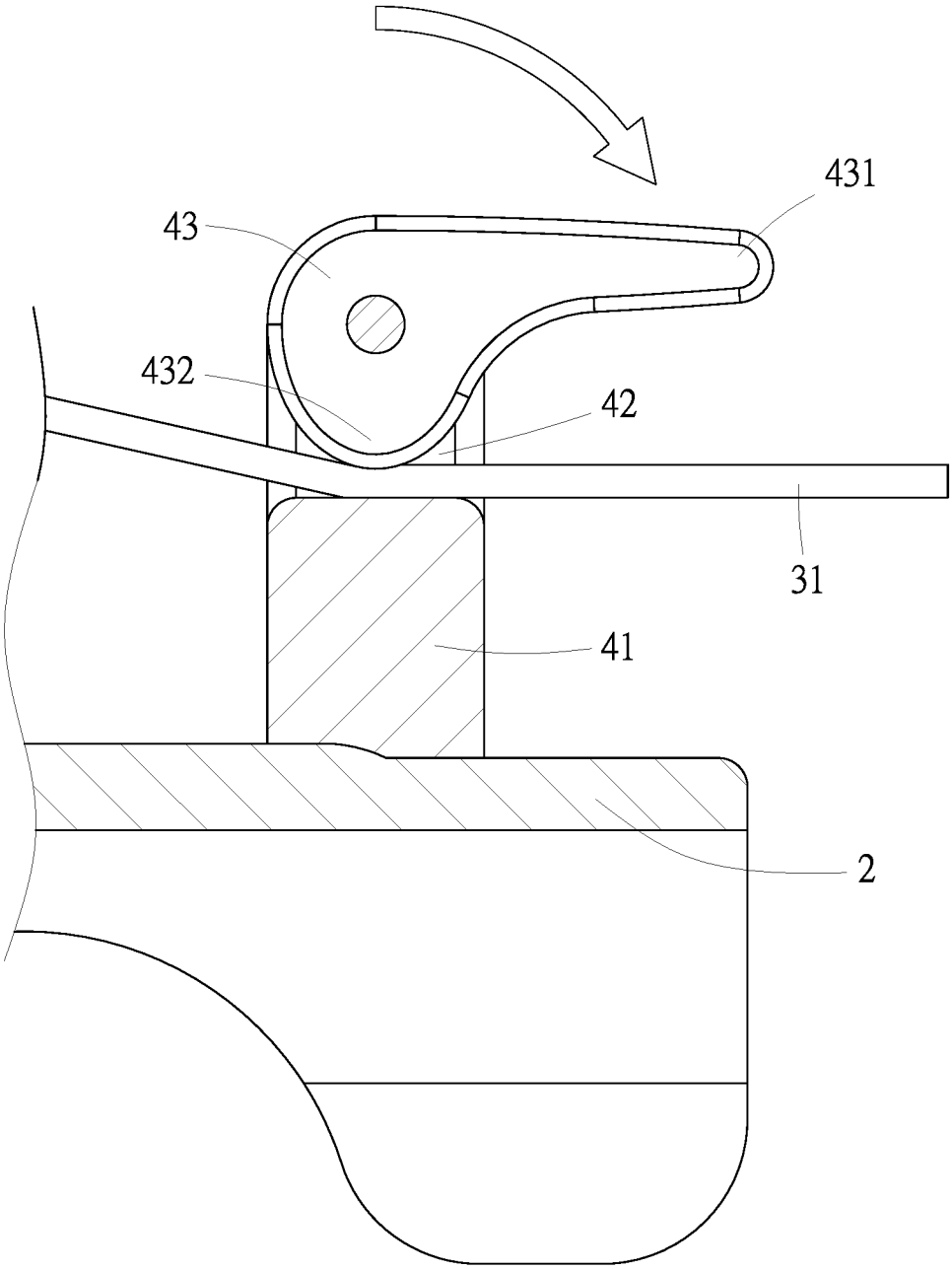
FIG. 8 is a schematic view showing that the elastic member is pressed and tightened by the pressing block according to the second embodiment of the present invention.

FIG. 7 and FIG. 8 illustrate a second embodiment of the present invention. The forearm orthosis body (2) includes a fixing seat (41). The fixing seat (41) has a pressing region (42). A plurality of pressing blocks (43) is pivotally connected to the fixing seat (41). Each of the pressing blocks (43) includes a pulling portion (431) and an eccentric cam portion (432). The pulling portion (431) is pulled to pivot the eccentric cam portion (432), so that the eccentric cam portion (432) is moved away from the pressing region (42). The second ends of the elastic members (31) are then inserted through the pressing region (42) and pressed and secured by the eccentric cam portions (432) of the pressing blocks (43).

When it is necessary to adjust the stretching tension for any one of the fingers (A1) or the thumb (A2), the corresponding pressing block (43) on the fixing seat (41) is loosened. By pulling the pulling portion (431) of the corresponding pressing block (43), the corresponding eccentric cam portion (432) is moved away from the pressing region (42) so that the second end of the corresponding elastic member (31) is no longer pressed. Then, according to the desired stretching tension for any of the fingers (A1) or the thumb (A2), the corresponding elastic member (31) is selectively tightened or loosened by adjusting the length of the second end of the corresponding elastic member (31) to be pressed under the pressing block (43), so that the elasticity of the elastic member (31) pressed under the pressing block (43) can be adjusted. In this way, the elasticity of the respective elastic members (31) can be adjusted according to different stretching tensions required by the fingers (A1) or the thumb (A2) for rehabilitation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tension adjustment structure of a hand rehabilitation device, comprising:

a palm orthosis body, including a plurality of adjustable finger support rods and an adjustable thumb support rod, the palm orthosis body including a plurality of first fixing portions and a plurality of adjustment seats, the adjustment seats being connected to respective ones of the first fixing portions by respective ones of a plurality of first fixing bolts, the adjustment seats being linearly and reversibly displaceable in a linear manner relative to a respective one of the first fixing portions for adjusting each of the adjustment seats to selectable locations on respective ones of the first fixing portions, each of the adjustable finger support rods being connected to a respective one of the adjustment seats by one of a plurality of second fixing bolts, whereby each of the adjustable finger support rods is configured to be turned and adjusted up and down relative to the corresponding adjustment seats for adjusting different angles of the adjustable finger support rods;

a forearm orthosis body, coupled to the palm orthosis body, the forearm orthosis body including a forearm fixing seat; and, a tension adjustment unit, including a plurality of elastic members, each of the elastic members having an elastic member first end connected to a respective one of the adjustable finger support rods and the adjustable thumb support rod each of the elastic members further including an elastic member second end connected to the forearm fixing seat, whereby each of the elastic members are adjustable to generate selectable stretching tensions by adjusting respective lengths of the elastic members to be secured to the forearm fixing seat.

2. The tension adjustment structure of the hand rehabilitation device as claimed in claim 1, wherein the adjustable finger support rods each have at least one perforation, and each of the elastic member first ends are inserted through the at least one perforation of the adjustable finger support rods and are connected to distal ends of the adjustable finger support rods, respectively.

3. The tension adjustment structure of the hand rehabilitation device as claimed in claim 1, wherein the palm orthosis body includes a thumb fixing portion, the adjustable thumb support rod is connected to the thumb fixing portion with a thumb fixing bolt, and the adjustable thumb support rod can be turned and adjusted up and down relative to the thumb fixing portion for adjusting a different angle of the adjustable thumb support rod.

4. The tension adjustment structure of the hand rehabilitation device as claimed in claim 1, wherein the forearm fixing seat has a lateral through hole, a pressing block is provided in the lateral through hole, the pressing block is formed with a penetrating hole corresponding to the lateral through hole, the forearm fixing seat is provided with a longitudinal adjustment bolt, one end of the longitudinal adjustment bolt is connected to the pressing block, the longitudinal adjustment bolt is rotatable on the forearm fixing seat to move the pressing block in the lateral through hole for the penetrating hole to be aligned or staggered with the lateral through hole so that the elastic member second ends are configured to be loosened or fastened for adjusting the respective lengths of the elastic member second ends to be pressed by the pressing block so as to generate the selectable stretching tensions.

5. The tension adjustment structure of the hand rehabilitation device as claimed in claim 1, wherein the forearm fixing seat has a pressing region, a plurality of pressing blocks is pivotally connected to the forearm fixing seat, each of the pressing blocks includes a pulling portion and an eccentric cam portion, the pulling portion is pulled to pivot the eccentric cam portion so that the eccentric cam portion is moved away from the pressing region, the elastic member second ends are inserted through the pressing region and pressed and secured by the eccentric cam portions of the pressing blocks, the elastic member second ends are displaceable for adjusting the respective lengths of the elastic member second ends to be pressed by the pressing blocks so as to generate the selectable stretching tensions.

6. The tension adjustment structure of the hand rehabilitation device as claimed in claim 1, wherein the palm orthosis body includes an orthosis body pivot portion, the forearm orthosis body includes a forearm pivot portion, and the forearm pivot portion is pivotally connected to the orthosis body pivot portion so that the palm orthosis body can pivot an angle relative to the forearm orthosis body.

7. The tension adjustment structure of the hand rehabilitation device as claimed in claim 1, wherein opposing sides of the forearm orthosis body are provided with fastening straps, the fastening straps are secured with a hook-and-loop tape, and a plurality of finger sleeves are connected to distal ends of the adjustable finger support rods and the adjustable thumb support rod, respectively.

8. The tension adjustment structure of the hand rehabilitation device as claimed in claim 1, wherein the plurality of elastic members are elastic ropes.

* * * * *